US005398992A

United States Patent [19]

Daniels

[11] Patent Number: 5,398,992

[45] Date of Patent: Mar. 21, 1995

[54] SEAT HAVING SOUND SYSTEM WITH ACOUSTIC WAVEGUIDE

[75] Inventor: Drew Daniels, North Hills, Calif.

[73] Assignee: The Walt Disney Company, Burbank, Calif.

[21] Appl. No.: 831,700

[22] Filed: Feb. 5, 1992

[51] Int. Cl.[6] ..... A47C 7/62

[52] U.S. Cl. ..... 297/217.4; 181/192; 297/188.04

[58] Field of Search ..... 297/217, 186, 194, 191; 181/192, 195

[56] References Cited

U.S. PATENT DOCUMENTS

| | | | |
|---|---|---|---|
| 1,577,911 | 3/1926 | Koch et al. . | |
| 2,908,766 | 10/1959 | Taylor . | |
| 4,020,284 | 4/1977 | Phillips . | |
| 4,082,159 | 4/1978 | Petty . | |
| 4,178,473 | 12/1979 | Vermeren . | |
| 4,567,959 | 2/1986 | Prophit . | |
| 4,758,047 | 7/1988 | Hennington | 297/217 X |
| 4,868,888 | 9/1989 | Dayton | 297/194 X |
| 4,979,777 | 12/1990 | Takada | 297/217 X |
| 5,143,055 | 9/1992 | Eakin | 297/217 X |
| 5,147,109 | 9/1992 | Jolly | 297/217 |

*Primary Examiner*—Philip C. Kannan
*Attorney, Agent, or Firm*—Pretty, Schroeder, Brueggemann & Clark

[57] ABSTRACT

A seat having an acoustic waveguide for conveying sound from a remotely mounted loudspeaker to a location in close proximity to an occupant's ears is disclosed. The seat comprises a horizontal seating member upon which an occupant may sit and a loudspeaker located under the seating member for generating sound to be conveyed to the occupant's ears. A back rest member extends upwardly from the seating member and comprises an acoustic waveguide coupled to the loudspeaker for conveying sound to the occupant. The waveguide terminates at an upper location such that a virtual sound source is located in close proximity to the occupant's ears. In its present form, the seat has special application in the amusement ride industry where the conveyance of intelligible sound to occupants may be difficult in view of the noisy environment in which such amusement rides tend to operate. Multiple loudspeakers in combination with specially shaped waveguides may be employed to convey stereo sound to multiple occupants.

21 Claims, 4 Drawing Sheets

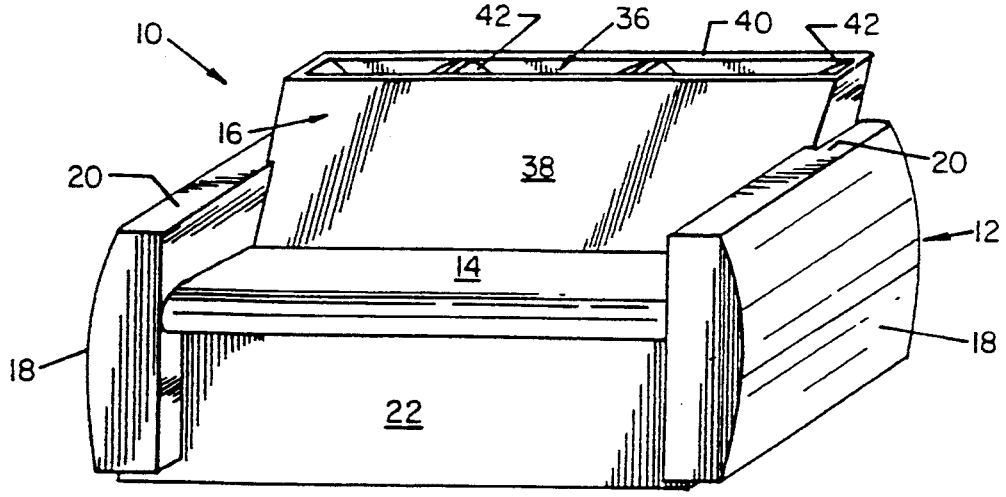
Fig. 1
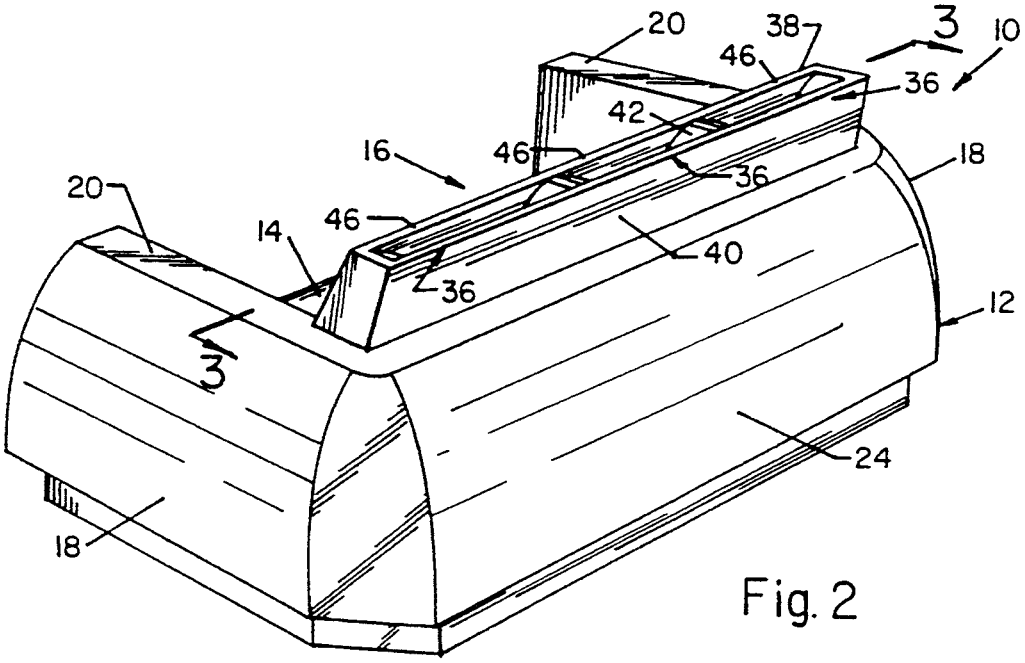
Fig. 2
Fig. 3
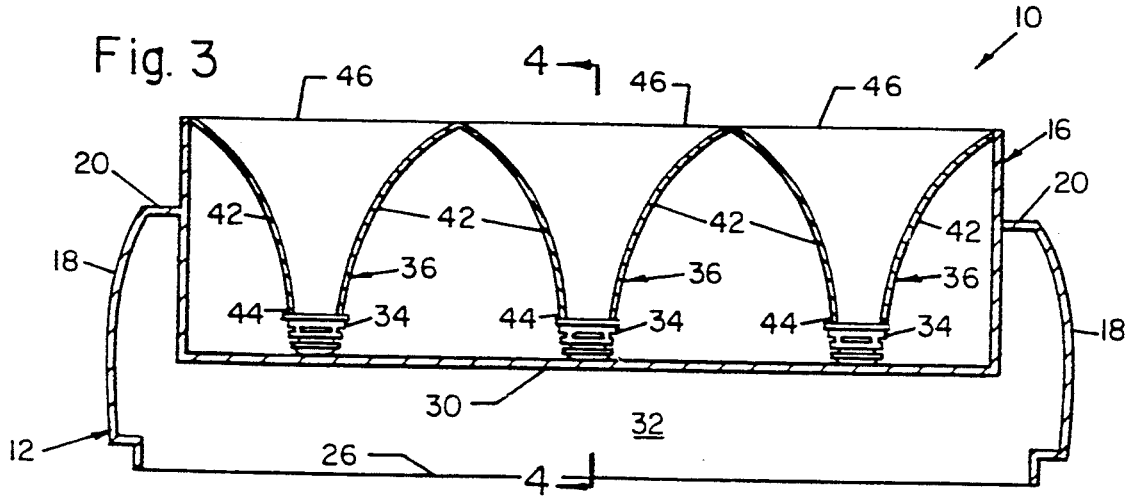

SEAT HAVING SOUND SYSTEM WITH ACOUSTIC WAVEGUIDE

BACKGROUND OF THE INVENTION

This invention relates to seats for use in ride vehicles having a sound-producing speaker and, more particularly, to a seat for use in a vehicle or the like having an acoustic waveguide for channeling sound from a speaker to an occupant's ears.

Many attractions at amusement and theme parks throughout the country have ride vehicles which transport occupants throughout the attraction. These ride vehicles typically are constructed without a top or windows, primarily to give the occupants an unrestricted view of the attraction. Depending upon the nature of the attraction, it may be desirable to tell a story, provide music or convey other sounds to the occupants as the ride vehicle moves throughout the attraction.

However, the inherent nature of most amusement ride vehicles and the seat construction described above tends to hinder intelligible sound conveyance or other communication with the occupants. While communication in such vehicles is generally carried out by use of an appropriate sound system including loudspeakers mounted on the ride vehicle, the ability to provide effective communication with good quality and fidelity is nevertheless difficult. This difficulty results primarily from the environment of the attraction which often exposes the occupant to noise generated by operation of the vehicle itself of other background noises, and vehicle design constraints generally make it impracticable to mount an appropriate loudspeaker in close proximity to the occupant's ears.

One common sound system in use today includes a small, low profile loudspeaker mounted on the ride vehicle in proximity to the occupant. However, these small loudspeakers typically suffer from an inherent lack of speech and sound intelligibility, primarily because such loudspeakers tend to achieve low acoustical conversion efficiency, since the loudspeakers tend to be small in size or low in quality. Vehicle design constraints also make it difficult and sometimes impossible to position these loudspeakers in sufficiently close proximity to the occupant's ears, and often these speakers are located in a side panel or other location that is not sufficiently close. Use of higher quality loudspeakers is sometimes impractical since there usually is insufficient space or the speakers must be mounted in a position even more remote from the occupant's ears. Such remote mounting decreases, not increases, the signal-to-noise ratio of the communication signal, and excessive power usually must be applied to the loudspeakers to produce the desired sound pressure level at the occupant's ears, which in turn, produces greater distortion.

Another solution to the foregoing problems has been to supply individual headsets to be worn by the occupants. However, this solution often is impractical, because these headsets are inconvenient to use and maintain and are susceptible to damage and theft. Moreover, in high throughput attractions, occupants may be hesitant from a sanitation and hygiene standpoint to wear a headset worn by a previous occupant, and it is generally impractical to clean such headsets and is presently quite expensive to replace them after each use.

Accordingly, there has existed a definite need for an amusement ride seat having a sound system capable of conveying intelligible sound to an occupant under conditions of noise, which does not require the occupant to wear headsets or the like, and which is capable of use with existing ride vehicles and other structures where it would otherwise be impractical to position high quality audio speaker equipment in proximity to the occupant's ears. The present invention satisfies these needs and provides further related advantages.

SUMMARY OF THE INVENTION

The present invention provides a seat having an acoustic waveguide which conveys sound from a remotely mounted loudspeaker or other sound source to a location in close proximity to an occupant's ears. In accordance with the invention, the waveguide comprises a structural back rest member of the seat, which itself may be incorporated in a vehicle or other environment. By incorporating the waveguide in the back rest of the seat, the waveguide conveys sound from the loudspeaker to the occupant, such that a virtual sound source is located in close proximity to the occupant's ears. The waveguide also enables high acoustical conversion efficiency, with a high signal-to-noise ratio.

In one preferred form of the invention, the seat comprises a substantially horizontal seating member upon which the occupant may sit, and a back rest member which extends upwardly from the seating member. A loudspeaker or other sound means for generating sound to be conveyed to the occupant's ears is located under the back rest member and generally beneath the horizontal seating member where more space is available. By coupling the acoustic waveguide to the loudspeaker, sound waves produced by the loudspeaker are propagated through the waveguide and therefore through the upper end of back rest member which it forms. In this way, the upper end of the acoustic waveguide opposite the loudspeaker, and the sounds which it produces, can be placed in close proximity to the occupant's ears.

More specifically, the acoustic waveguide comprises a front back rest member and a rear back rest member spaced from each other. A pair of flared side members extending substantially between the front back rest member and the rear back rest member are spaced apart from each other by a relatively small distance at their lower ends to form a narrow base coupled to the loudspeaker. As the flared side members extend upwardly between the front and rear back rest members, they are spaced apart by a progressively wider distance, forming a substantially horn-shaped waveguide. At the upper end of the back rest member, an aperture is formed in the waveguide at the location where the front and rear back rest members and the pair of flared side members join with each other. Optional structural support members, such as vanes, may be placed within the acoustic waveguide to further support the front to back rest member with respect to the rear back rest member. These structural support members also may function as guides to direct sound from the loudspeaker out of the aperture in a more uniformly distributed manner.

In one aspect of the invention, the back rest member comprises a plurality of waveguides placed in a side-by-side relationship. Unlike many conventional horns which are used to provide a wide angle of dispersion, however, the acoustic waveguide of the present invention is characterized by a low flare rate so that a virtual sound source may be placed in close proximity to the occupant and directed specifically towards the occupant's ears. This can be accomplished by making the cross-sectional area of the waveguide either constant or only slightly increasing in an axial direction. This is in contrast to most conventional horns which frequently have a flare rate of ten or more.

The acoustic waveguide of the present invention also preferably yields a relatively large signal to noise ratio. By using a waveguide with a near zero flare rate to convey sound from the loudspeaker, intelligible sound conveyance and other high fidelity communication is made possible, without undue concern for design constraints which otherwise would produce lower quality sound. For example, a high quality sound system and loudspeaker may be utilized and placed underneath the horizontal seating member where space is more readily available. Thus, the drawbacks of using small, low profile loudspeakers is avoided. Positioning of the loudspeaker also is not a problem, since the waveguide effectively conveys the sound from the remotely mounted loudspeaker to a location in close proximity with the occupant's ears.

In one preferred embodiment, it is anticipated that the top of the back rest member and aperture of the waveguide would terminate at about shoulder height of most individuals, so that a virtual sound source would be placed within about one foot or less from an average occupant's ears. Distortion problems also are reduced since excessive power is not required to drive the loudspeakers. Moreover, the acoustic waveguide forming the back rest member is reliable in operation, simple to maintain and relatively inexpensive to manufacture, while providing high quality, high fidelity and intelligible sound in close proximity to the occupant's ears.

In a further embodiment of the invention, the seat may employ multiple loudspeakers and specially configured waveguides connected to each loudspeaker. In this embodiment, each waveguide has multiple outputs, with each output directed to a different occupant. In this way, stereo or multi-channel sound may be conveyed separately to each occupant, while using a minimum number of loudspeakers.

While the invention provides a seat for directing sound from a remote sound source to a location in close proximity to an occupant's ears, and while the preferred embodiment of the invention is intended for use primarily in ride vehicles, it will be appreciated that there are other applications of the seat not explicitly explained herein that nevertheless may utilize the principles of the invention.

Other features and advantages of the present invention will become apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is a front perspective view of a seat embodying the novel features of the present invention;

FIG. 2 is a rear perspective view of the seat;

FIG. 3 is a cross-sectional elevational view of the seat, taken substantially along line 3—3 of FIG. 2, showing a plurality of acoustic waveguides forming a back rest of the seat;

DETAILED DESCRIPTION OF THE PREFERRED EMBODIMENT

Figure 4:
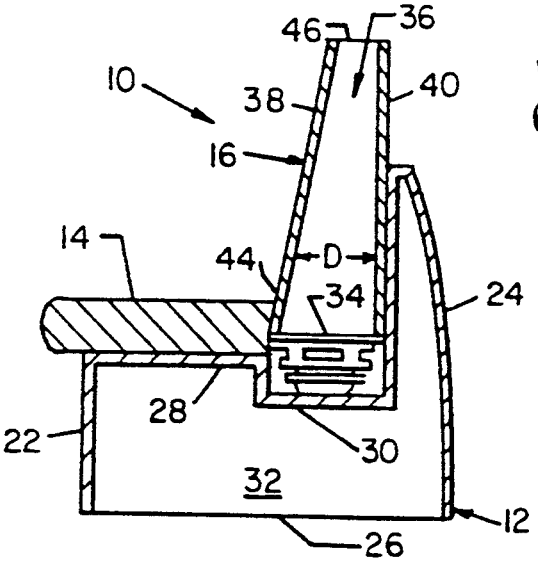
FIG. 4 is another cross-sectional elevational view of the seat, taken substantially along line 4—4 of FIG. 3.

As shown in the exemplary drawings, the present invention is embodied in a seat, generally referred to by the reference numeral 10, for use in connection with a vehicle 12 or other seating environment. Referring to FIGS. 1–2, the seat 10 comprises a substantially horizontal seating member forming a bench 14 and a substantially vertical member forming a back rest 16. The side ends of the bench 14 and back rest 16 are bordered by side panels 18 forming arm rests 20 for one or more occupants seated on the bench.

FIGS. 3–4 illustrate cross-sectional views of the seat 10. Here it is seen that the seat 10 further includes a front panel 22 and a back panel 24 extending to a floor, and a vehicle chassis or the like 26 for supporting the seat. A horizontal bench support 28 and a horizontal back rest support 30, in combination with the front panel 22, back panel 24 and floor 26, together combine to form a hollow compartment 32 having a relatively sizeable volume. The horizontal back rest support 30 extends into this compartment 32 for supporting one or more loudspeakers 34 for producing sound from a remote electrical sound source (not shown). Depending upon the size of the loudspeakers 34, the horizontal back rest support 30 may extend further into the hollow compartment 32 as may be necessary.

In accordance with the invention, the back rest 16 is constructed and arranged in such a way that it forms an acoustic waveguide 36 coupled to the loudspeaker 34 for conveying sound from the loudspeaker to an occupant seated on the bench 14. With reference again to FIGS. 3–4, the waveguide 36 which forms the back rest 16 comprises a front back rest member 38 and a rear back rest member 40 spaced from each other by a depth D. In the embodiment of the waveguide 36 shown in FIGS. 3–6, the front back rest member 38 is slightly inclined and the rear back rest member 40 is substantially vertical. A pair of flared side members 42 on the acoustic waveguide 36 extend by the distance D substantially between the front and back rest members 38 and 40 and are spaced apart from each other at the lower end of the waveguide 36 by a relatively small distance $W_1$ to form a narrow base 44 coupled to the loudspeaker 34. At the upper end of the waveguide 36, the flared side members 42 are spaced apart from each other by a progressively wider distance $W_2$ as the side members 42 extend or flare away from each other and the loudspeaker 34. Also, at the upper end of the waveguide 36, the front and rear back rest members 38 and 40 and the flared side members 42 come together to define an aperture 46 opposite the narrow base 44. The upper end of the waveguide preferably is arranged so that the aperture 46 is in close proximity to the occupant's ears.

Sounds conveyed by the acoustic waveguide 36 are intended to be heard from no more than substantially one foot away from the aperture 46 at the upper end of the waveguide 36. This is in contrast to conventional horns or waveguides, which generally are designed to produce a sound field at a greater distance. Therefore, it is anticipated that the aperture 46 at the upper end of the waveguide 36 will be positioned at a location corresponding to the shoulders of an average height person sitting on the bench 14. In this way, sounds conveyed by the waveguide 36 should retain their high quality, fidelity and intelligibility for average height people, as well as children or taller people, within a statistically acceptable range.

The waveguide 36 of the present invention is generally in the shape of a horn of the type conventionally used in certain sound systems as an acoustic transformer. Thus, the horn acts as a gain device for presentation of sound to a listener. In the present invention, sound generated by the loudspeaker 34 is collimated by the waveguide 36 to present the maximum signal to the listener, rather than dispersing the sound like a typical loudspeaker over a 360° angle with only a portion of the sound reaching the listener. The collimated sound results in the movement or propagation of a column of air within the horn. Horns typically are characterized by a "flare rate" which corresponds to the rate at which the transverse cross-sectional area of the horn increases.

Like conventional horns, the waveguide 36 of the present invention functions by channeling and propagating a column of air or sound waves produced by the loudspeaker 34 toward the listener. Unlike traditional horns, however, which have a flare rate which may be used to produce acoustical gain or dispersion pattern control, the preferred embodiment of the present invention utilizes a waveguide 36 having a near zero or only slightly increasing or decreasing flare rate. By maintaining a near zero flare rate, in which the cross-sectional area of the waveguide 36 remains relatively constant, the most effective gain is achieved. This results in placing a virtual sound source in close proximity to the listener's ears, with the advantage of reduced or limited dispersion and therefore low attenuation.

In one aspect of the invention, the narrow base 44 where the waveguide 36 is coupled to the loudspeaker 34 has a cylindrical shape defining a circular transverse cross-section, while the upper end of the waveguide 36 at the aperture 46 has a generally rectangular transverse cross-section. To prevent distortion, the transition between the circular shape of the narrow base 44 and the rectangular shape of the aperture 46 must be a smooth transition. Moreover, the transverse cross-sectional area of the waveguide 36 should remain relatively constant or only slightly increasing or decreasing, in order to satisfy the preferred requirement of a near zero flare rate. If these requirements are not met, sound with distortion and coloration normally will result.

Figure 5:
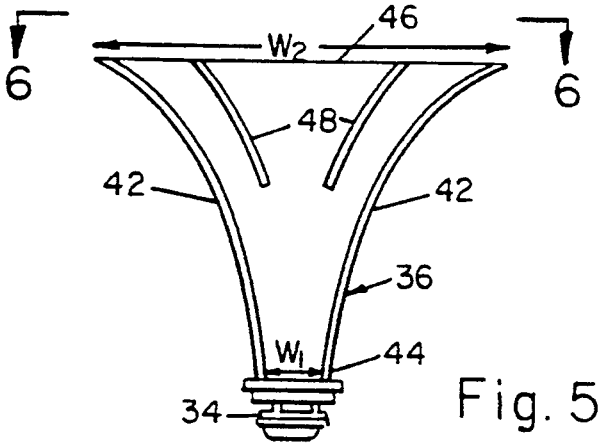
FIG. 5 is a cross-sectional elevational view of one embodiment of an acoustic waveguide in accordance with the present invention.
Figure 6:
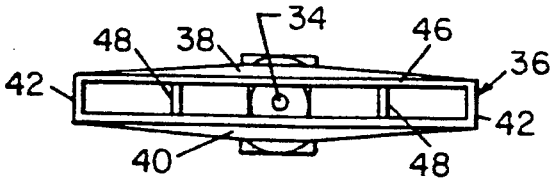
FIG. 6 is a plan view of the acoustic waveguide, taken substantially along line 6—6 of FIG. 5.

In one embodiment of the invention shown in FIGS. 4–6, the waveguide 36 expands in an axial direction from the narrow base 44 towards the aperture 46 so that sound waves from the loudspeaker 34 are propagated in a vertical direction toward the occupant's ears. In order to maintain a relatively constant or only slightly increasing cross-sectional area of the waveguide 36, and considering the increasingly wider spacing $W_2$ between the flared side members 42 which tends to increase the cross-sectional area, the front-to-back depth D of the waveguide 36 (FIG. 4) must therefore decrease in an axial direction from the narrow base 44 to the aperture 46. This decrease in width can be calculated mathematically in proportion to the flare rate of the waveguide 36.

As shown in FIG. 5, a pair of curved vanes 48 are provided within the waveguide 36. These vanes 48 extend from the aperture 46 downwardly into the waveguide 36 about one-third of its axial length and are designed to provide two specific functions. The first function of the vanes 48 is to provide additional structural support between the front back rest member 38 and the rear back rest member 40 of the waveguide 36. This supporting function is especially useful for waveguides 36 in which there is a wide spacing between the two flared side members 42. The second function is to help divert the propagating sound waves laterally towards the sides of the waveguide 36 to thereby produce a more uniform distribution of sound exiting the aperture 46.

Figure 7:
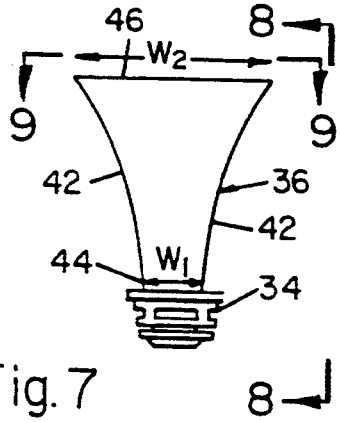
FIG. 7 is an elevational view of another embodiment of an acoustic waveguide in accordance with the present invention.
Figure 8:
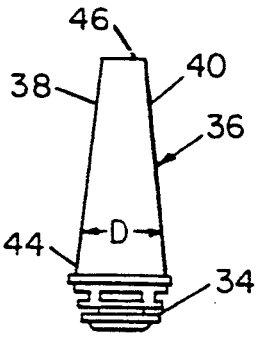
FIG. 8 is an elevational view of the acoustic waveguide, taken substantially along line 8—8 of FIG. 7.
Figure 9:
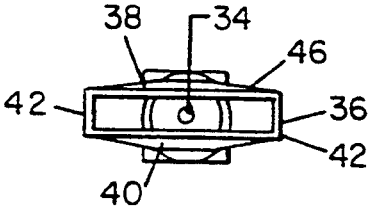
FIG. 9 is a plan view of the acoustic waveguide, taken substantially along line 9—9 of FIG. 7.

FIGS. 7–9 show another embodiment of the waveguide 36. In this embodiment, the spacing $W_2$ between the flared side members 42 is not as large, as the distance between the flared side members increases at a smaller rate than in the case of the first embodiment of FIGS. 4–6. In this second embodiment, the flare rate is also preferably near zero or only slightly increasing. Again, this is accomplished by decreasing the depth D of the waveguide 36 as it increases in an axial direction from the narrow base 44 toward the aperture 46.

FIG. 8 is an elevational view of the second embodiment of the waveguide 36, in which both the front back rest member 38 and the rear back rest member 40 are inclined with respect to the axis of the waveguide. In this configuration, the waveguide 36 which forms the back rest 16 of the seat 10 may be used where the back rest comprises a common seat back for occupants on each side with their backs to each other. Of course, the first embodiment of the waveguide 36 shown in FIGS. 4–6 also could be constructed such that the front and rear back rest members 38 and 40 are inclined with respect to each other in the same fashion.

Figure 10:
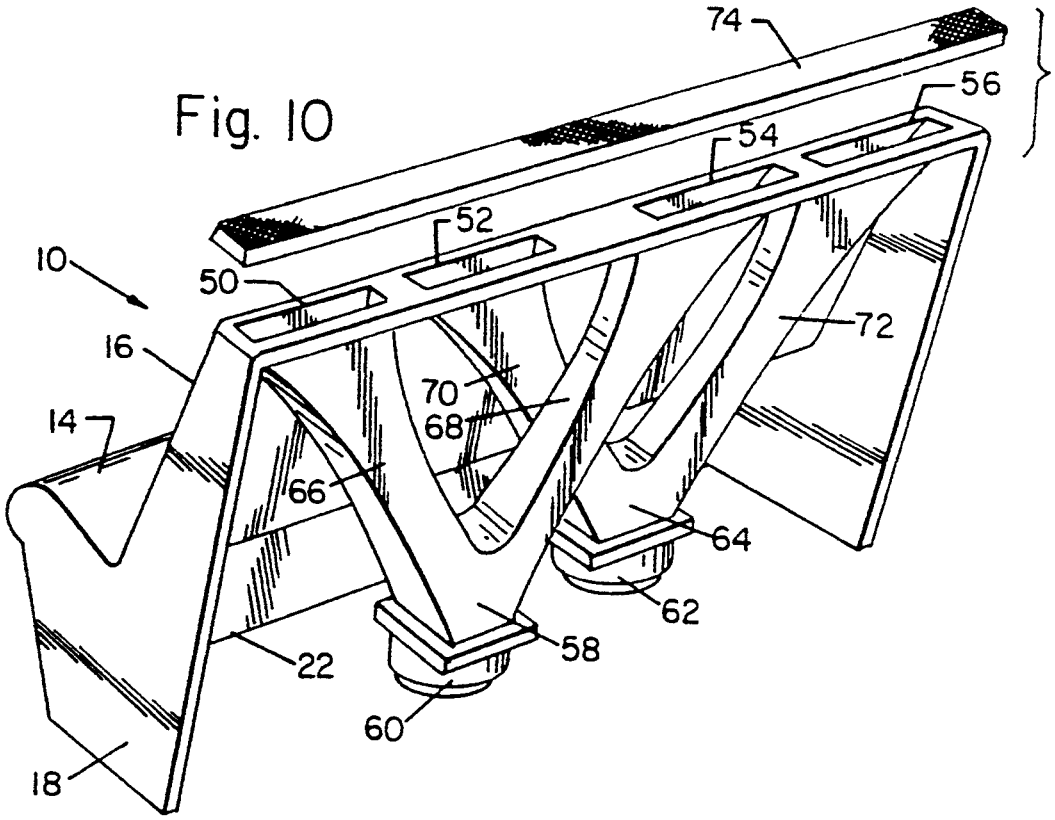
FIG. 10 is a rear perspective view of a seat showing another embodiment of the invention.

FIG. 10 is a perspective view of another embodiment of the invention. In this embodiment, the seat 10 has four spaced-apart apertures 50, 52, 54 and 56 at the upper end of the back rest 16. The first and second apertures 50 and 52 are designed to convey sound to an occupant seated on one end of the seat 10, while the third and fourth apertures 54 and 56 are designed to convey sound to an occupant seated at an opposite end of the seat. It is noted that the first and third apertures 50 and 54 are commonly connected by a first Y-shaped waveguide 58 to a first loudspeaker 60, and the second and fourth apertures 52 and 56 are commonly connected by a second Y-shaped waveguide 62 to a second loudspeaker 64. Each of the Y-shaped waveguides 58 and 62 has two separate outputs leading to a respective one of the apertures. Thus, the two outputs 66 and 68 of the first waveguide 58 lead to the first and third apertures 50 and 54, respectively, while the two outputs 70 and 72 of the second waveguide 62 lead to the second and fourth apertures 52 and 56, respectively. In this way, stereo or multi-channel sound can be communicated to the occupants. Moreover, this embodiment has the advantage that only two loudspeakers 60 and 64 are needed to convey stereo sound to each of the occupants, while effectively providing each occupant with the equivalent of two dedicated speakers for stereo output. An optional grill 74 to cover the apertures also may be provided.

Figure 11:
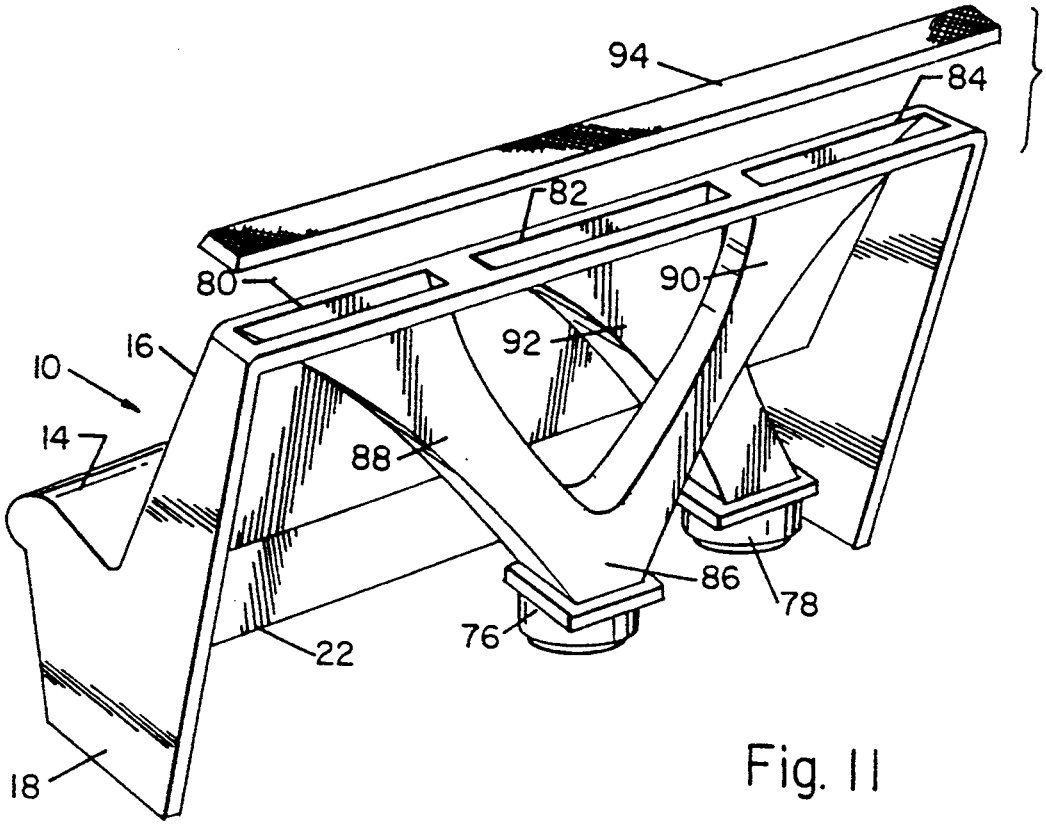
FIG. 11 is a rear perspective view of a seat showing yet another embodiment of the invention.

FIG. 11 shows another embodiment of the invention in which stereo sound may be communicated to two occupants on opposite sides of the seat. In this embodiment, like the embodiment of FIG. 10, two loudspeakers 76 and 78 are used. However, only three apertures 80, 82 and 84 are provided. The first and third apertures 80 and 84 are commonly connected by a Y-shaped waveguide 86 (having two separate outputs 88 and 90) to the first loudspeaker 76, while the second aperture 82 is connected solely to the second loudspeaker 78. To provide sufficient output from the second loudspeaker 78 to both occupants, the second aperture 82 may be slightly larger than the first and third apertures 80 and 82, as illustrated. An optional grill 94 also may be provided.

Figure 12:
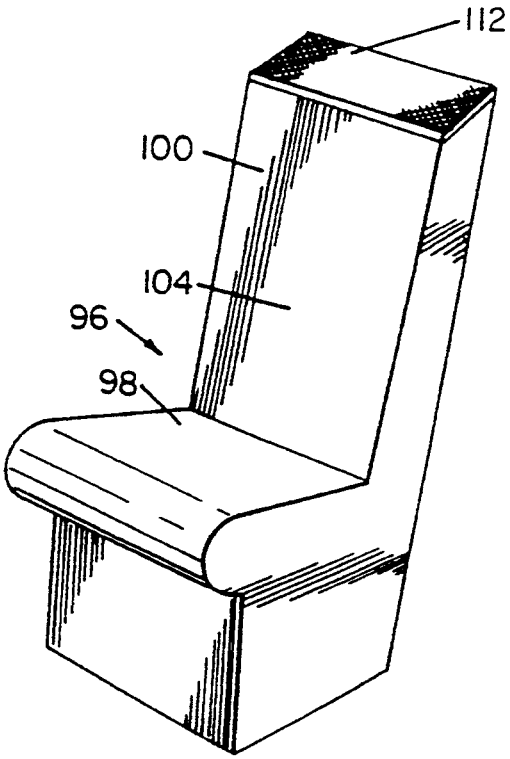
FIG. 12 is a front perspective view of a chair showing another embodiment of the invention.
Figure 13:
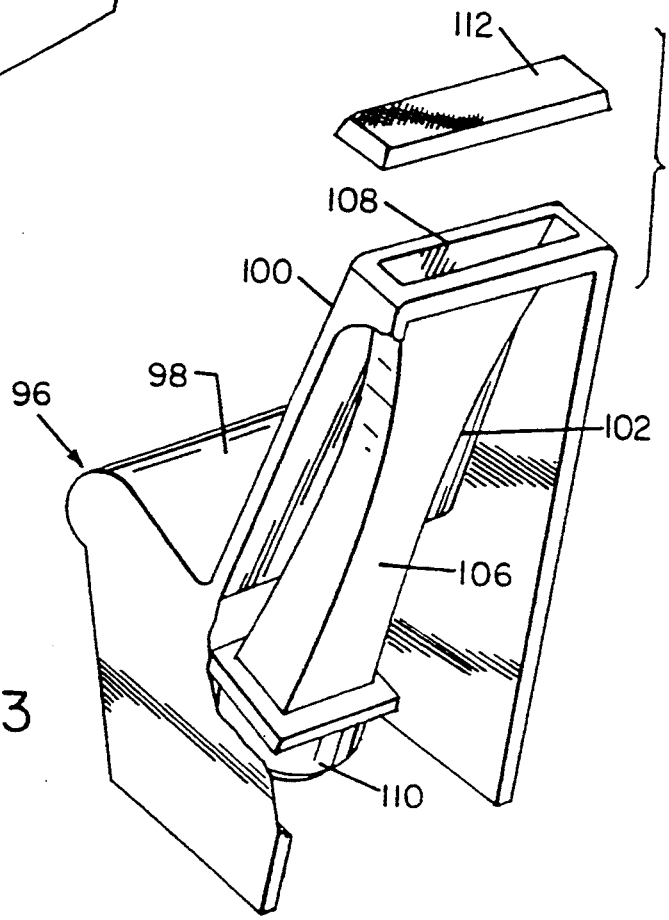
FIG. 13 is a rear perspective view of the chair of FIG. 12.

FIGS. 12 and 13 show yet another embodiment of the invention, wherein the seat 10 comprises a chair 96 having a horizontal seating surface 98 and a substantially vertical back rest 100. Similar to the embodiment discussed above in connection with FIGS. 1–4, a single waveguide 102 comprising a front back rest member 104 and a rear back rest member 106 are used to form the back rest 100 of the chair 96. A single aperture 108 is provided in the chair 96, with the lower end of the waveguide connected to a single loudspeaker 110. Stationary, free-standing chairs 96 of the type illustrated in FIGS. 12–13 could be used in consumer applications or institutional applications, for example, for training drivers in vehicles or flight simulators. An optional grill 112 also is provided.

The seat 10 constructed in accordance with the present invention provides many distinct advantages. One important advantage, as noted above, is the ability to place a virtual sound source in close proximity to the occupant's ears. With the aperture 46 of the waveguide 36 preferably only a foot away or less from the occupant's ears, sound having essentially the same quality as a loudspeaker 34 in the same position is provided. Another important advantage is the ability to utilize high quality sound equipment without undue concern for the availability of space to install such equipment. By placing the loudspeaker 34 or other sound equipment within the hollow compartment 32, where space is relatively generous, larger and higher quality loudspeakers may be used. Servicing of the loudspeaker 34 or other sound equipment also is greatly facilitated by this construction, either by removing the back rest 16 or by gaining access through the front or rear panels 22 and 24.

The seat 10 of this invention has particular application in amusement and theme parks where it may be incorporated into a ride vehicle 12 of the type that travels through an attraction. In such attractions, a series of pre-recorded sounds or messages are played as the vehicle 12 moves along a path throughout the attraction. Hence, such sounds or messages will be complimentary to the ride or attraction for which the vehicle 12 is used. Since the environment of such attractions often exposes the occupant to noise generated by the operation of the vehicle itself or other background noises, the waveguide 36 substantially improves the signal-to-noise ratio, and thus the sound quality, fidelity and intelligibility, by placing a virtual sound source in close proximity to the occupant's ears. Stereo sound also may be separately provided to two occupants, yet using only two loudspeakers.

From the foregoing, it will be appreciated that the seat 10 of the present invention provides a means for conveying sound of high quality and intelligibility to a listener under adverse acoustical conditions. The construction of the seat 10 and waveguide 36 advantageously enable placement of a loudspeaker 34 having high acoustical conversion efficiency in a normally impractical position, remote from the occupant, while still providing a virtual sound source in close proximity to the occupant's ears. In this way, previously wasted space can be made useable. Additionally, spacial constraints in the design and construction of the seat 10 are not violated, as the seat back 16 itself, through the waveguide 36, is used to propagate the virtual sound to the occupant's ears.

While a particular form of the invention has been illustrated and described, it will be apparent that various modifications can be made without departing from the spirit and scope of the invention. Therefore, it is not intended that the invention be limited, except as by the appended claims.

I claim:

1. A seat, comprising:

a substantially horizontal seating member upon which an occupant may sit;

a sound source for generating sound to be conveyed to the occupant's ears; and a back rest member connected to and extending upwardly from the seating member for direct contact with the occupant, wherein the back rest member comprises an acoustic waveguide, comprising a front back rest member, a rear back rest member, and a pair of flared side members extending substantially between the front back rest member and the rear back rest member, the flared side members being spaced apart from each other by a relatively small distance to form a narrow base coupled to the sound source, and by a progressively wider distance as the side members extend away from the sound source to define an aperture in close proximity to the occupant's ears, and wherein the cross-sectional area of the waveguide is substantially constant in the axial direction from the narrow base to the aperture, such that a virtual sound source is located in close proximity to the occupant's ears.

2. The seat of claim 1, further comprising a structural support member within the acoustic waveguide to further support the front back rest member with respect to the rear back rest member.

3. The seat of claim 1, further comprising a plurality of vanes in the waveguide to uniformly distribute sound as it exits the aperture of the waveguide.

4. The seat of claim 1, wherein the back rest member comprises a plurality of waveguides.

5. The seat of claim 1, wherein the sound source is located adjacent to the point where the seating member and back rest member are joined.

6. The seat of claim 5, wherein the sound source comprises a loudspeaker.

7. The seat of claim 1, wherein the acoustic waveguide is circular in cross-section at the narrow base and rectangular in cross-section at the aperture.

8. The seat of claim 1, wherein the acoustic waveguide is in the shape of a horn.

9. The seat of claim 1, wherein the seat is incorporated in a vehicle.

10. A combination, comprising:

a vehicle for movement along a path; and a seat for carrying an occupant in the vehicle, wherein the seat comprises:

a substantially horizontal seating member upon which the occupant may sit;

a sound source for generating sound to be conveyed to the occupant's ears; and a back rest member connected to and extending upwardly from the seating member for direct contact with the occupant, wherein the back rest member comprises an acoustic waveguide coupled to the sound source for conveying sound from the sound source to the occupant, such that a virtual sound source is located in close proximity to the occupant's ears, wherein the seat further comprises:

a front back rest member, a rear back rest member spaced from the front back rest member, and a pair of flared side members extending substantially between the front back rest member and the rear back rest member, the flared side members being spaced apart from each other by a relatively small distance to form a narrow base coupled to the sound source, and being spaced apart from each other by a progressively wider distance as the side members extend away from the sound source, and wherein the cross-sectional area of the waveguide is substantially constant in the axial direction from the narrow base to the aperture.

11. The combination of claim 10, further comprising a structural support member within the acoustic waveguide to further support the front back rest member with respect to the rear back rest member.

12. The combination of claim 10, further comprising a plurality of vanes in the waveguide to uniformly distribute sound as it exits the aperture of the waveguide.

13. The combination of claim 10, wherein the back rest member comprises a plurality of waveguides.

14. The combination of claim 10, wherein the sound source is located adjacent to the point where the seating member and back rest member are joined.

15. The combination of claim 10, wherein the acoustic waveguide is circular in cross-section at the narrow base and rectangular in cross-section at the aperture.

16. The combination of claim 15, wherein the acoustic waveguide is in the shape of a horn.

17. The combination of claim 10, wherein the cross-sectional area of the waveguide is slightly increasing in the axial direction from the narrow base to the aperture.

18. A seat, comprising:

a substantially horizontal seating member upon which two occupants may sit;

a first sound source and a second sound source;

a first acoustic waveguide coupled to the first sound source, wherein the first acoustic waveguide has a first output for conveying sound from the first sound source to one of said two occupants and a second output for conveying sound from the first sound source to the other of said two occupants; and a second acoustic waveguide coupled to the second sound source, wherein the second acoustic waveguide has a first output for conveying sound from the second sound source to said one of said two occupants and a second output for conveying sound from the second sound source to said other of said two occupants.

19. A seat, comprising:

a substantially horizontal seating member upon which two occupants may sit;

a first sound source and a second sound source;

a first acoustic waveguide coupled to a first sound source, wherein the first acoustic waveguide has a single output for conveying sound from the first sound source to each of said two occupants; and a second acoustic waveguide coupled to the second sound source, wherein the second acoustic waveguide has a first output for conveying sound from the second sound source to one of said two occupants and a second output for conveying sound from the second sound source to the other of said two occupants.

20. A structural member for supporting a person's back, comprising a sound source and a back rest member in the form of an acoustic waveguide coupled to the sound source for conveying sound from the sound source to a location in close proximity to the person's ears, wherein the back rest member comprises a front back rest member, a rear back rest member spaced from the front back rest member, and a pair of flared side members extending substantially between the front back rest member and the rear back rest member forming a narrow base coupled to the sound source and an aperture opposite the narrow base and in close proximity to the occupant's ears, and wherein the cross-sectional area of the waveguide is substantially constant in the axial direction from the narrow base to the aperture.

21. A seat, comprising:

a substantially horizontal seating member upon which an occupant may sit;

a sound source for generating sound to be conveyed to the occupant's ears; and a back rest member extending upwardly from the seating member, wherein the back rest member comprises an acoustic waveguide having a front back rest member, a rear back rest member spaced from the front back rest member, and a pair of flared side members extending substantially between the front back rest member and the rear back rest member, the flared side members being spaced apart from each other by a relatively small distance to form at one end of the acoustic waveguide a narrow base coupled to the sound source, and the flared side members being spaced apart from each other by a progressively wider distance to form at the other end of the acoustic waveguide an aperture in close proximity to the occupant's ears, wherein the cross-sectional area of the waveguide is substantially constant in the axial direction from the narrow base to the aperture.

* * * * *